US005957071A

United States Patent [19]

Brock

[11] Patent Number: 5,957,071

[45] Date of Patent: Sep. 28, 1999

[54] SAILBOAT

[76] Inventor: William D. Brock, 4898 Euclid Rd., Virginia Beach, Va. 23462

[21] Appl. No.: 08/878,673

[22] Filed: Jun. 20, 1997

Related U.S. Application Data

[60] Provisional application No. 60/020,943, Jul. 1, 1996.

[51] Int. Cl.[6] ..... B63B 35/00

[52] U.S. Cl. ..... 114/39.11; 114/61

[58] Field of Search ..... 114/39.1, 61, 102, 114/103, 153; D12/304

[56] References Cited

U.S. PATENT DOCUMENTS

| | | | |
|---|---|---|---|
| D. 249,493 | 9/1978 | Rineman | D12/304 |
| D. 317,000 | 5/1991 | Berghoef, Jr. | D12/304 |
| D. 370,885 | 6/1996 | Brock | D12/304 |
| 2,654,335 | 10/1953 | Ball | 114/153 |
| 3,802,366 | 4/1974 | Mankawich | 114/39.1 |
| 4,054,100 | 10/1977 | Rineman | 114/39.1 |
| 4,082,053 | 4/1978 | Woodward | 114/39.1 |
| 4,294,184 | 10/1981 | Heinrich | 114/61 |
| 4,503,795 | 3/1985 | Krans | 114/39.1 |
| 4,539,926 | 9/1985 | Boffer | 114/39.1 |
| 4,757,777 | 7/1988 | Rosenberger | 114/61 |
| 4,771,716 | 9/1988 | Dat | 114/61 |
| 4,815,407 | 3/1989 | Carn | 114/103 |
| 4,890,570 | 1/1990 | Hofmeister | 114/39.1 |
| 5,024,177 | 6/1991 | Winter et al. | 114/61 |
| 5,231,943 | 8/1993 | Benze | 114/102 |

*Primary Examiner*—Jesus D. Sotelo
*Attorney, Agent, or Firm*—Greenblum & Bernstein P.L.C.

[57] ABSTRACT

A sailboat having a cross-shaped body to which a pair of pontoons are attached. Additionally, a pontoon-like rudder is attached to the aft portion of the body. A steering mechanism is provided for steering the rudder by application of force, via the operator's feet, to a stirrup. A sail is mounted via front and aft masts. The sail include a handle so that the operator can move the sail left and right by hand.

15 Claims, 4 Drawing Sheets

SAILBOAT

RELATED APPLICATION DATA

This application claims the benefit under 35 U.S.C. § 119(e) of U.S. provisional application No. 60/020,943, filed Jul. 1, 1996, entitled "Sailboat", the disclosure of which is expressly incorporated herein by reference in its entirety.

BACKGROUND OF THE INVENTION

1. Field of the Invention

The present invention concerns a single person sailboat, and seating and control arrangement therefor.

2. Description of Background Information

Many different small sailing craft are known in the art. U.S. Pat. No. 4,294,184, discloses a multi-hull craft steering system having a plurality of hulls or floats. One hull is a pivotally mounted steering hull located between and ahead of the remaining hulls. The steering hull is hand controlled with a steering wheel which is located for operation in plain view of the operator while the operator is in a forward looking position. A cable interconnects the steering wheel with a pulley that is coaxially mounted to a shaft. A rudder is connected to the opposite end of the shaft, so that turning of the steering wheel, and thus, rotation of the pulley, causes a left or right turning motion of the rudder. With this device, cable stretching commonly occurs through repeated use of the steering mechanism. As the cable stretches, increasing amounts of slop are introduced into the steering mechanism, thereby negatively effecting the precision of the steering control. The left/right movement of the steering hull is accomplished via a wheel connected to a linkage comprised of a pulley and a sheet or cable.

U.S. Pat. No. 4,757,777 discloses a sailing vessel which includes an elongated forward strut, two elongated aft struts and a mast. Pontoons are attached to the distal ends of the struts. The operator may control the trimming of the sail via a cord, and manipulate the tiller via foot on a rudder assembly which includes a plate-like fin for steering the boat. The rudder assembly is releasably secured to a cross-beam of the boat. The rudder assembly is pivotally mounted to a bracket. A tiller is attached to the rudder mechanism, for operation by the feet of the user, in order to pivot the rudder in a left or right direction. The direct connection between the tiller and the rudder mechanism requires that the operator be positioned substantially directly above the position of the rudder. Further, this device does not allow forward positioning of the operator during control of the rudder mechanism.

U.S. Pat. No. 3,802,366 discloses a sailing craft including a main hull flanked by two outrigger hulls. A steering mechanism is comprised of an inverted V-shaped hydrofoil which is mounted at the stern of the main hull. The V-shaped hydrofoil is pivotal relative to the main hull about both the vertical and horizontal axes to control direction and lift. It is responsive to the operation of a handle attached at the end of steering mechanism. The handle is pivotally mounted to the hull of the sailboat at the stem, by a shaft which interconnects the handle and the rudder. This type of known steering mechanism requires the operator to manipulate the steering mechanism without looking at the same, if the operator is assumed to be looking forward to ensure where he is going.

SUMMARY OF THE INVENTION

One advantage of the present invention is achieved by providing a steering mechanism which overcomes the problems experienced by known mechanisms.

Another advantage of the present invention is to provide an attractive, lightweight, easy to use sailboat which can be steered by the feet of the operator. Additionally, the sail is easily manipulated by hand.

The present invention includes a sailboat having a body which is substantially cross-shaped. On arm extends from each side of the cross and are separated to form a catamaran-like support. Each of the arms is connected with a pontoon. A forward protruded section of the body is for attachment of a forward point of a sail and for mounting support for a stirrup which is used for direction control of the sailboat. An aft section of the body is molded for a seat, and includes a sail mast holder and connecting point for the rudder of the sailboat.

The pontoons are attached to the body, one on each side, to create a catamaran-like stability. Preferably, the pontoons are molded with the body to form a one piece unit.

The rudder is a separate pontoon to control left and right movement of the sailboat. The rudder is controlled by two push-pull tubes, crossed and attached to a stirrup. When an operator rotates the stirrup to the left, the sailboat steers to the left. Conversely, when an operator rotates the stirrup to the right, the sailboat steers to the right.

The sail is preferably of a triangular jib-like configuration. The sail provides the propulsion for the sailboat, as it catches the wind. The sail preferably includes an aft mast, a forward mast and a sail handle, and is about four square meters in area. The components of the sail are preferably molded together as a one piece unit. The aft mast is attached to the sailboat just aft of the seat and the forward mast is attached to the further most point of the forward section. The sail is designed to swing on either side of the body and may also be latched to the center line of the body.

According to an aspect to the invention, a boat includes a body having an upper surface and a lower surface. A steering actuator is pivotally mounted at the upper surface of the body by a first pivot shaft and extends through the body to the lower surface. At least one substantially rigid member has a first end and a second end. The first end is connected to the first pivot shaft at the lower surface and the second end is connected to a rudder, which is pivotally mounted to steer the boat.

The boat includes a first bellcrank fixedly mounted to the first pivot shaft, and the first end of the at least one substantially rigid member is connected to the first bellcrank. A second bellcrank is fixedly mounted to the second pivot shaft, and the second end of the at least one substantially rigid member is connected to the second bellcrank.

According to another aspect of the invention, two substantially rigid members are used. Each of the first ends of the two substantially rigid members are connected to the first bellcrank and each of the second ends are connected to the second bellcrank. The two substantially rigid members cross one another substantially midway of their lengths and the substantially rigid member may be tubular members.

The steering actuator may be a stirrup which is controlled by the feet of an operator. A seat is located adjacent the stirrup.

According to another aspect of the invention, the body includes first and second arms extending transversely therefrom, and first and second pontoons are respectively connected to the first and second arms. The rudder is also shaped as a pontoon.

According to another aspect of the invention, the boat further includes a sail mounted to the body, and a forward mast, the sail being integrally molded to the forward mast. A handle is connected to the sail for grasping by an operator, and the sail includes a latch for securing the sail to the body in a position aligned with a center line of said boat. An aft mast is mounted between said body and an upper end of said forward mast.

Other objects and advantages of the present invention and advantageous features thereof will become apparent as the description proceeds herein.

BRIEF DESCRIPTION OF THE DRAWINGS

The present invention is further explained in the description which follows with reference to the drawings, illustrating, by way of non-limiting examples, the invention, with like reference numerals representing similar parts throughout the several views, and wherein.

DESCRIPTION OF THE PREFERRED EMBODIMENTS

Figure 1:
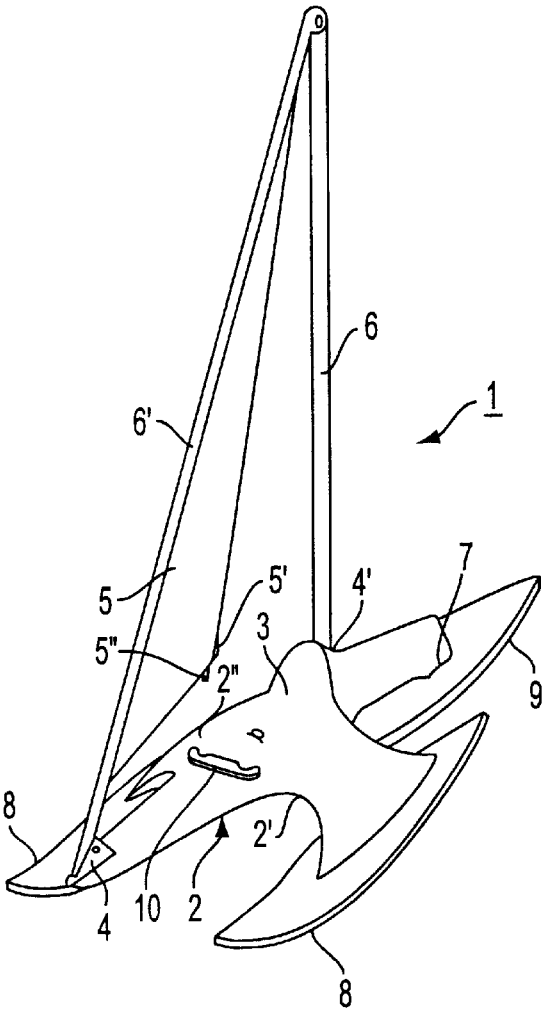
FIG. 1 is a perspective view of the sailboat according the present invention.

Referring now to the drawings in detail, FIG. 1 shows a perspective view of a sailboat 1 according to the present invention. The sailboat 1 includes a body 2 which is generally cross or "tee" shaped. The body is preferably formed of molded fiberglass, but could also be plastic, wood, or other commonly known and used marine materials. Each of the arms 2' and 2" are connected to pontoons 8 on the left and right sides of the body to impart catamaran-like stability to the sailboat.

Pontoons 8 are preferably integrally molded with the body 2 as one piece, but may also be provided individually and mounted to the body 2. Each of the pontoons 8 includes a pontoon rudder 12 extending downwardly therefrom to impart directional stability to the sailboat.

The forward portion of the body 2 provides a base for mounting the forward point of the sail 5 and the stirrup 10. The aft section of the body 2 is molded to form a seat 3 for the operator. The aft section also serves as a base for mounting the aft mast 6 and the rudder 9 is also mounted thereto.

The sail 5 is preferably of a triangular jib-like configuration. However, the sail may be trapezoidal or in other well-known shapes. The sail is preferably integrally molded as one piece with the forward mast 6' and the sail handle 5'. The sail handle 5' is configured for grasping by the operator while occupying a seated position in seat 3. Thus, the operator may swing the sail 5 to the left or right of the center line of the sailboat 1. The sail also includes a latch 5' for securing the sail 5 to the body 2 in a position aligned with the center line of the sailboat 1.

The aft mast 6 is removably attached to the body 2. Likewise, the forward mast 6' is removably attached to the body, for easy disassembly of the sail from the body of the sailboat. The sail 5 can be freely pivoted to the left or right of the center line of the sailboat 1.

A rudder 9 is separately molded into a pontoon shape, and is pivotally mounted to the aft portion of the body 2. Thus, the rudder 9 can be rotated left and right for directional control of the sailboat. The stirrup 10 makes up a portion of the steering mechanism 13, of which the rudder 9 is a part, and is controlled by the feet of the operator for controlling the positioning of the rudder 9.

Figure 2:
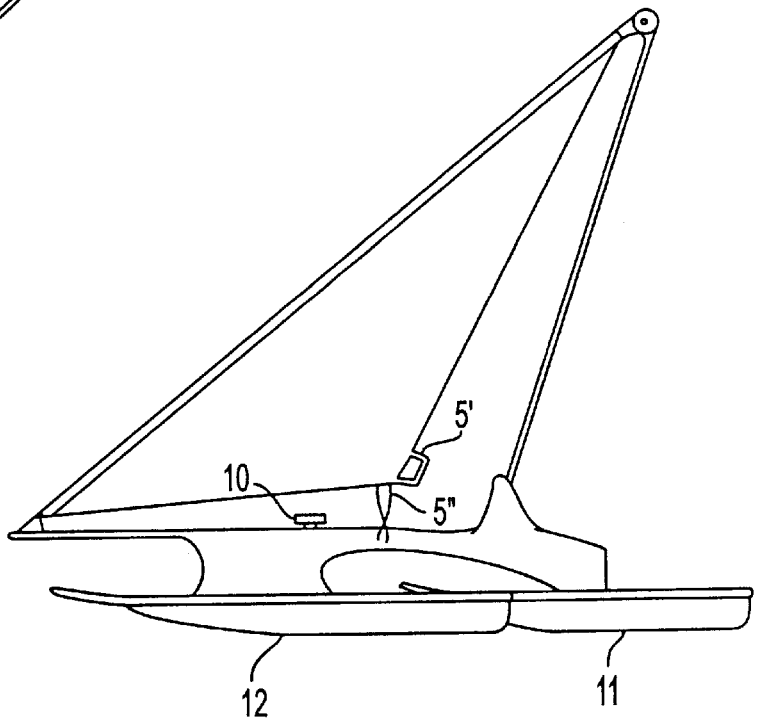
FIG. 2 is right side view of the sailboat shown in FIG. 1.
Figure 3:
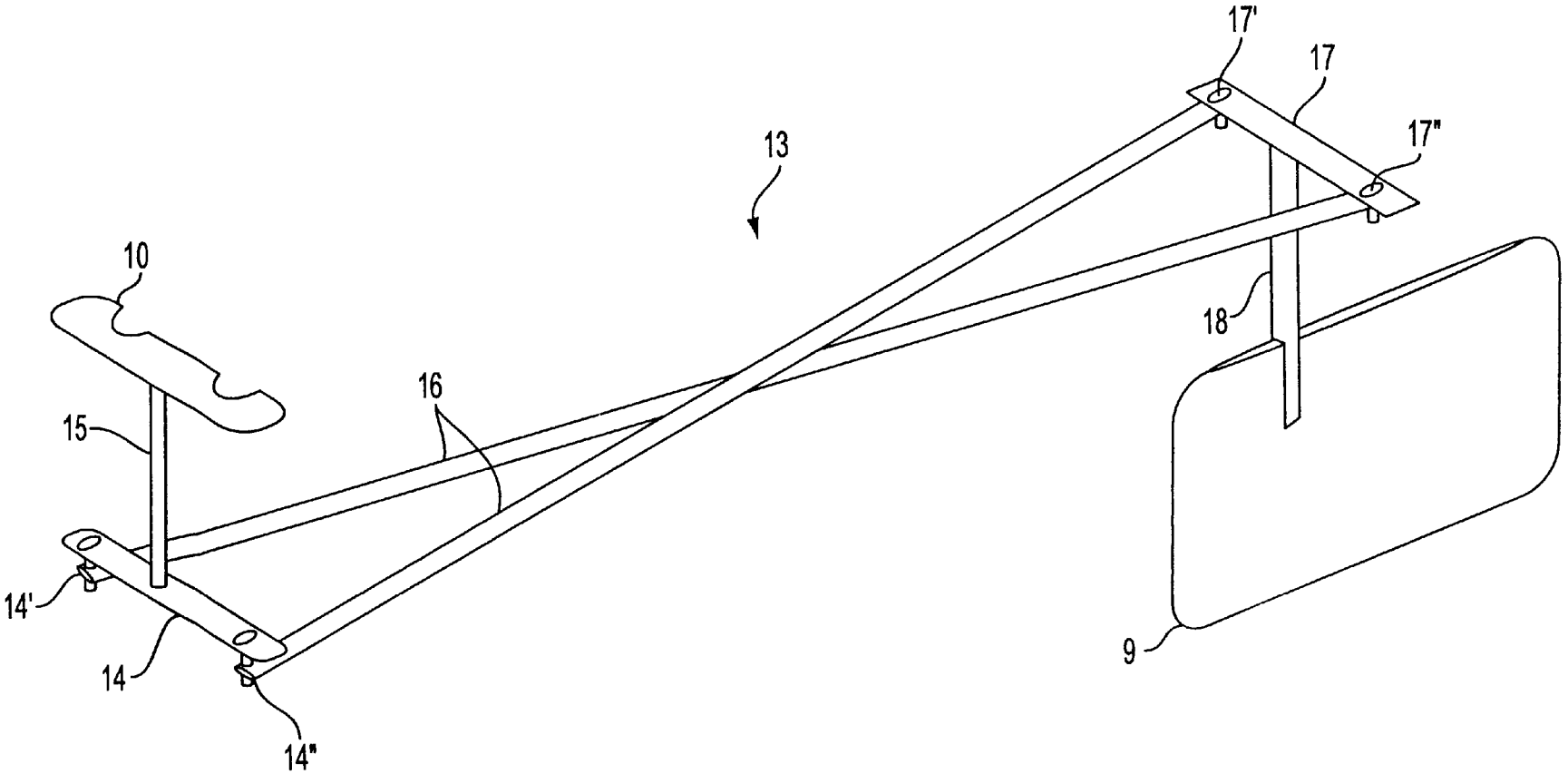
FIG. 3 is an illustration of the steering mechanism of the sailboat according to the present invention.
Figure 4:
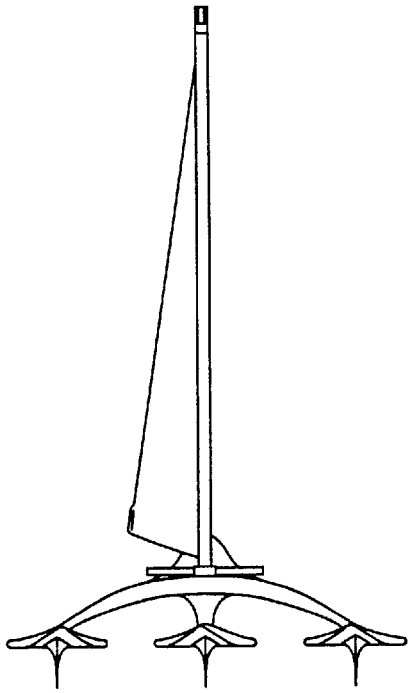
FIG. 4 is front elevational view of the sailboat shown in FIG. 1.
Figure 5:
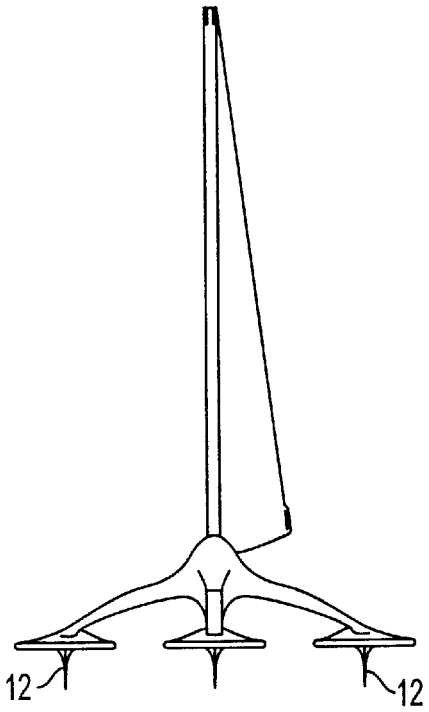
FIG. 5 is rear elevational view of the sailboat shown in FIG. 1.
Figure 6:
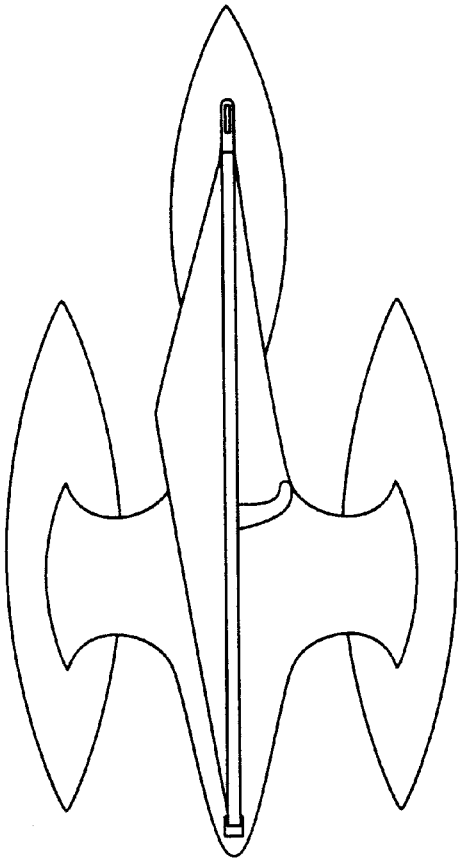
FIG. 6 is a top plan view of the sailboat shown in FIG. 1.
Figure 7:
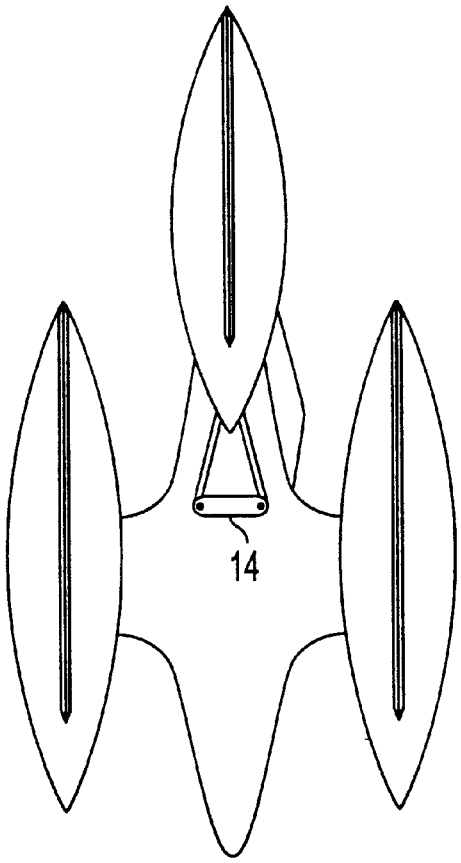
FIG. 7 is a bottom plan view of the sailboat shown in FIG. 1.

Referring to FIG. 3, the stirrup 10 is fixedly mounted to forward bellcrank 14 via the forward pivot shaft 15. The forward pivot shaft extends through and is pivotally mounted to body 2. As shown in FIGS. 1 and 2, the stirrup 10 extends above the surface of body 2 for actuation by the feet of the operator during steering maneuvers. The bellcrank 14 extends beneath the surface of the body 2 as shown in FIG. 7.

A pair of push/pull members 16 are pivotally attached to opposite ends of the forward bellcrank 14 at 14' and 14". The push/pull members 16 are substantially rigid and are preferably tubular in shape, but may also be made to have a square or rectangular cross-section, and may even be solid rods, although this adds weight to the design. The push/pull members cross one another substantially midway of their lengths, and are pivotally connected to opposite ends of an aft bellcrank 17 at 17' and 17".

The aft bellcrank 17 is fixedly mounted to the rudder 9 via the aft pivot shaft 18. The aft pivot shaft 18 is pivotally mounted in the aft section of body 2 and the rudder 9 extends therefrom, as shown in FIGS. 1, 2, 4, 5 and 7. In operation, when the operator rotates the stirrup 10 to the left, the movement is transferred, via the push/pull members 16, to cause the rudder 9 to turn so as to perform a left turn of the sailboat 1. When the operator rotates the stirrup 10 to the right, the movement is transferred, via the push/pull members 16, to cause the rudder 9 to turn so as to perform a right turn of the sailboat 1.

Although the invention has been described with reference to particular means, materials and embodiments, it is to be understood that the invention is not limited to the particulars disclosed and extends to all equivalents thereof.

What is claimed is:

1. A boat comprising:

a body having an upper surface and a lower surface; and a steering actuator pivotally mounted at said upper surface of said body by a first pivot shaft, said steering actuator is a stirrup, said stirrup being controlled by the feet of an operator, said first pivot shaft extending through said body to said lower surface, at least one substantially rigid member having a first end and a second end, said first end being connected to said first pivot shaft at said lower surface and said second end being connected to a rudder, said rudder being pivotally mounted to steer said boat.

2. The boat according to claim 1, further comprising a first bellcrank fixedly mounted to said first pivot shaft, said first end of said at least one substantially rigid member being connected to said first bellcrank.

3. The boat according to claim 2, further comprising a second bellcrank fixedly mounted to a second pivot shaft, said second end of said at least one substantially rigid member being connected to said second bellcrank.

4. The boat according to claim 3, comprising two substantially rigid members, each of said first ends of said two substantially rigid members being connected to said first bellcrank and each of said second ends being connected to said second bellcrank.

5. The boat according to claim 4, wherein said two substantially rigid members cross one another substantially midway of their lengths.

6. The boat according to claim 1, wherein said at least one substantially rigid member is a tubular member.

7. The boat according to claim 1, further comprising a seat adjacent said stirrup.

8. The boat according to claim 1, said body including first and second arms extending transversely therefrom, and first and second pontoons being respectively connected to said first and second arms.

9. The boat according to claim 8, wherein said rudder is shaped as a pontoon.

10. The boat according to claim 1, further comprising a sail mounted to said body.

11. The boat according to claim 10, further comprising a forward mast, said sail being integrally molded to said forward mast.

12. The boat according to claim 11, further comprising a handle connected to said sail for grasping by an operator.

13. The boat according to claim 11, said sail including a latch for securing said sail to said body in a position aligned with a center line of said boat.

14. The boat according to claim 11, further comprising an aft mast mounted between said body and an upper end of said forward mast.

15. A boat comprising:

a body having an upper surface and a lower surface, said body including first and second arms extending transversely therefrom, and first and second pontoons being respectively connected to said first and second arms; and a steering actuator pivotally mounted at said upper surface of said body by a first pivot shaft, said first pivot shaft extending through said body to said lower surface, at least one substantially rigid member having a first end and a second end, said first end being connected to said first pivot shaft at said lower surface and said second end being connected to a rudder, said rudder being pivotally mounted to steer said boat, wherein said rudder is shaped as a pontoon.

* * * * *